United States Patent [19]

Wyland et al.

[11] 4,333,825

[45] Jun. 8, 1982

[54] DUMP PIT MAGNET ASSEMBLY

[75] Inventors: Donald J. Wyland, Brighton; Michael W. Stowe, Pontiac, both of Mich.

[73] Assignee: Industrial Magnetics, Inc., Troy, Mich.

[21] Appl. No.: 229,297

[22] Filed: Jan. 28, 1981

[51] Int. Cl.[3] ..... B03C 1/14

[52] U.S. Cl. ..... 209/223 A; 209/228; 209/231; 210/222

[58] Field of Search ..... 209/215, 223 A, 223 R, 209/228, 231, 232, 636, 217; 210/222, 223; 414/198, 395

[56] References Cited

U.S. PATENT DOCUMENTS

| | | | |
|---|---|---|---|
| 430,280 | 6/1890 | Edison | 209/232 |
| 560,184 | 5/1896 | Barnard | 209/223 R |
| 767,105 | 8/1904 | Dings | 209/223 R X |
| 2,709,002 | 5/1955 | Huff | 209/215 |
| 2,939,580 | 6/1960 | Carpenter | 210/222 X |
| 3,139,403 | 6/1964 | Cramer | 210/222 |
| 3,168,464 | 2/1965 | Ferris | 209/223 R |
| 3,343,675 | 9/1967 | Budd | 209/215 |
| 3,421,666 | 1/1969 | Lawson | 209/223 R X |
| 4,176,065 | 11/1979 | Cook | 209/223 R |
| 4,208,278 | 6/1980 | Stekly | 210/222 X |

FOREIGN PATENT DOCUMENTS

| | | | |
|---|---|---|---|
| 1091688 | 10/1955 | Fed. Rep. of Germany | 210/222 |
| 563022 | 7/1944 | United Kingdom | 209/232 |
| 117169 | 4/1958 | U.S.S.R. | 209/223 R |

*Primary Examiner*—R. Halper

*Attorney, Agent, or Firm*—Barnes, Kisselle, Raisch & Choate

[57] ABSTRACT

A dump pit for grain has a magnet cylinder fixedly mounted therein with its axis extending through an access door opening on the dump pit. A non-magnetic shell is slideably arranged over the magnet and is adapted to be retracted through the door opening so that the tramp metal accumulating on the shell will simply fall off when the shell is retracted.

5 Claims, 3 Drawing Figures

DUMP PIT MAGNET ASSEMBLY

This invention relates to a dump pit such as used for grain and, more particularly, to a magnet assembly for removing tramp metal from the grain flowing through the dump pit.

In the process of loading and conveying grain the grain is frequently discharged downwardly through a dump pit in the form of a hopper, the bottom of which empties onto a screw or drag type conveyor. In order to protect the conveyor and other equipment used for handling and processing grain, it is important to remove all tramp metal from the grain.

The primary object of this invention is to provide a magnet assembly designed to be mounted within a dump pit to remove tramp metal from the grain discharged therethrough.

A further object of the invention is to provide a magnet assembly of the type described constructed to remove tramp metal from a dump pit without the necessity of removing the magnet itself.

Another object of the invention is to provide a magnet assembly of the type described which includes a magnet cylinder adapted to be fixedly mounted in a dump pit and a shell telescopically arranged over the cylinder and designed to be retracted axially through an access opening in the dump pit to discharge the tramp metal clinging thereto by reason of the magnetic forces produced by the magnet cylinder.

Other objects, features and advantages of the present invention will become apparent from the following description and accompanying drawings, in which.

Figure 1:
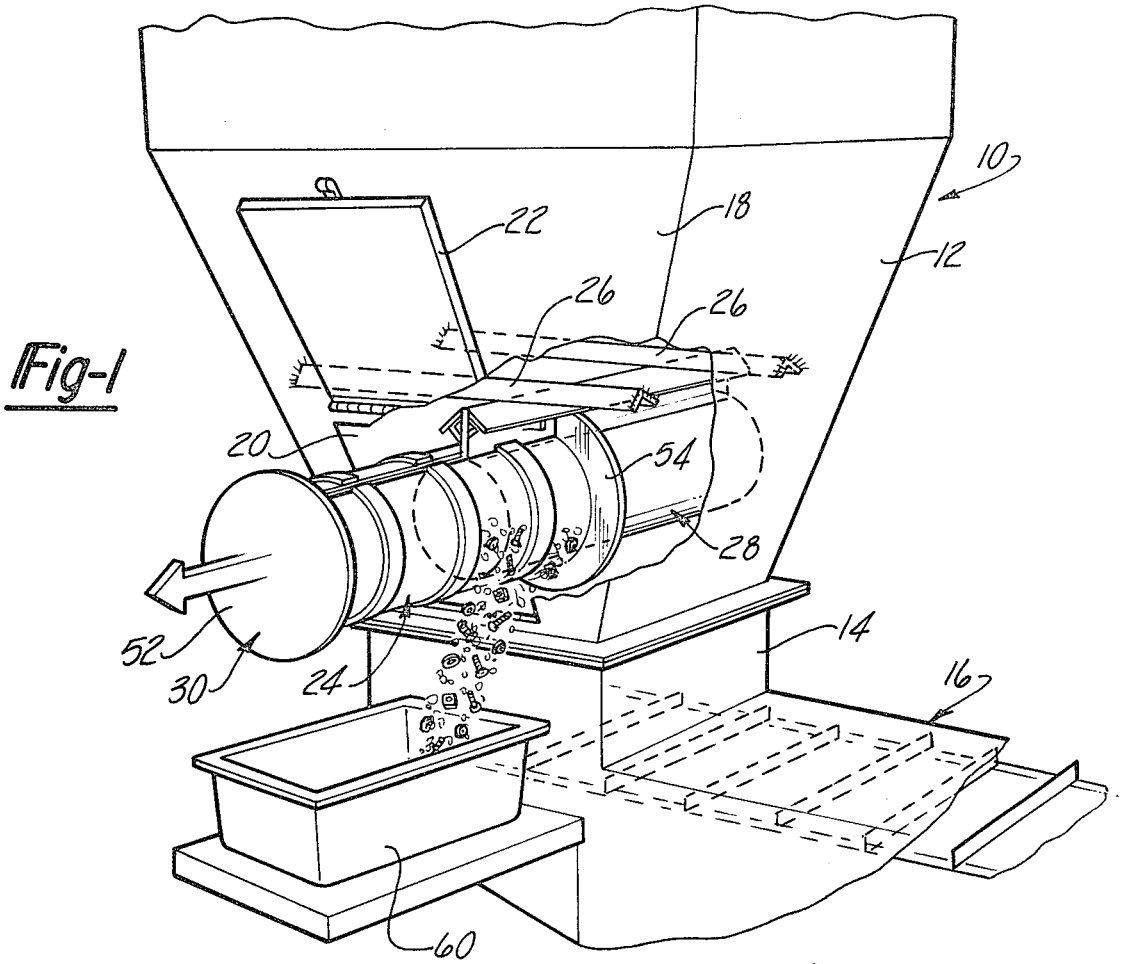
FIG. 1 is a perspective view with parts broken away of a dump pit provided with the magnet assembly of this invention.

In FIG. 1 there is illustrated a dump pit, generally designated 10, having side walls 12 which slope inwardly in a downwardly direction so that the bottom of the dump pit discharges into the inlet 14 of a conveyor 16. The front wall 18 of dump pit 10 has an access opening 20 closed by a hinged door 22. The magnet assembly of the present invention, generally designated 24, is mounted within dump pit 10 by means of a pair of angle brackets 26 which are suitably fixed, as by welding, to the side walls 12 of the dump pit.

Figure 2:
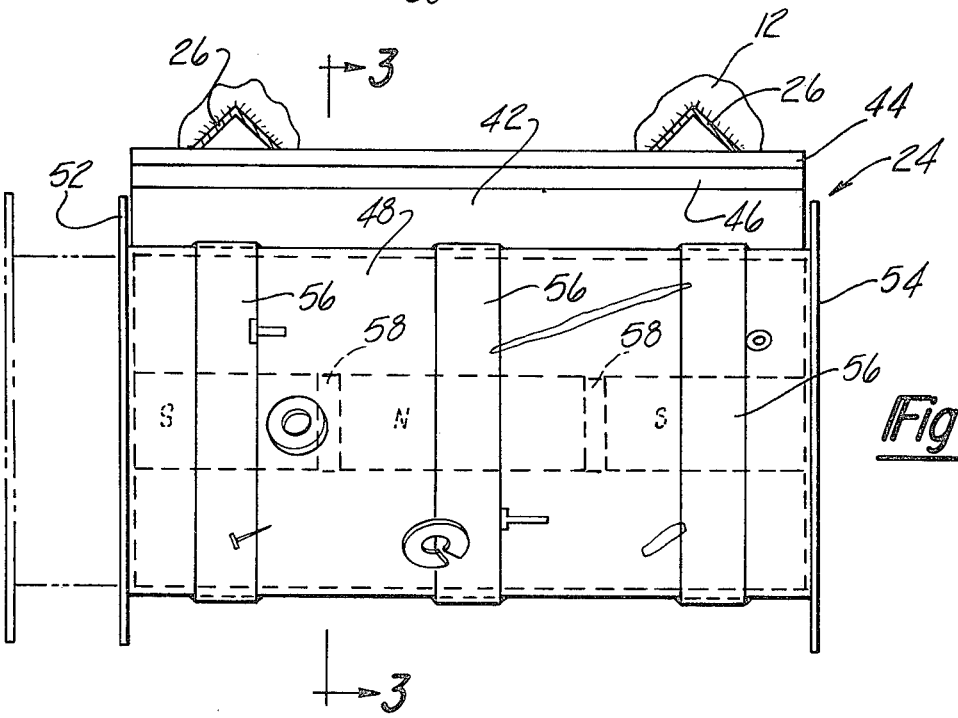
FIG. 2 is a side elevational view of the magnet assembly.
Figure 3:
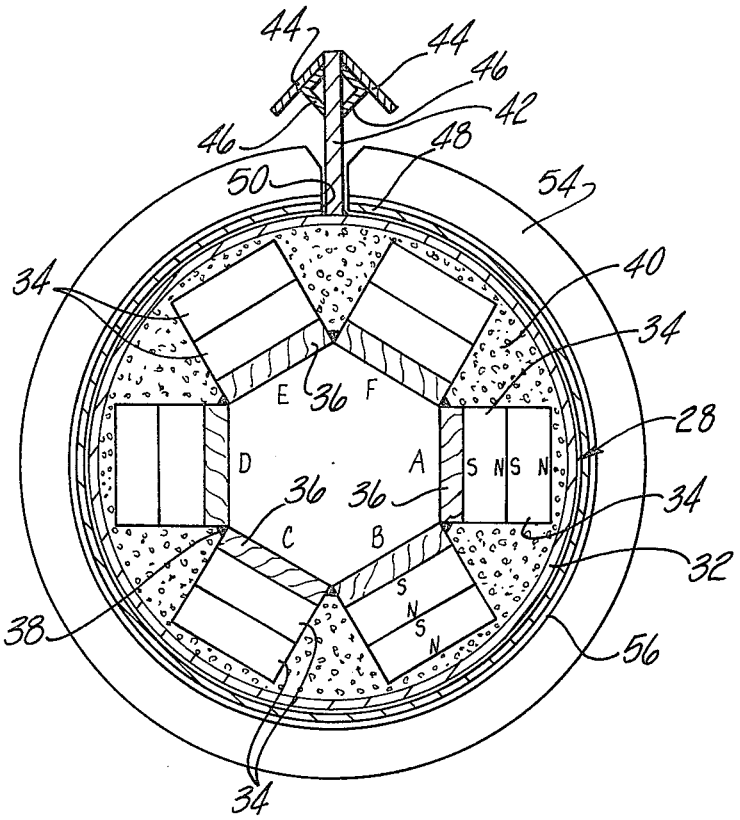
FIG. 3 is a sectional view taken along the line 3—3 in FIG. 2.

The magnet assembly consists generally of a magnet cylinder 28 and a stripper shell 30. Referring to FIG. 3, a magnet cylinder 28 comprises a tube 32 of circular cross section formed of magnetic material. Within tube 32 there are arranged six circumferentially spaced, axially extending rows of magnets. In FIG. 3 these rows are designated, A, B, C, D, E and F. The row A of magnets is shown in broken lines in FIG. 2. The magnets themselves are designated 34. Each row contains three sets of magnets spaced axially apart and each set of magnets consists of two magnets which are polarized and stacked radially as shown in FIG. 3. The axially adjacent sets of magnets in each row are oppositely polarized and the successive sets of circumferentially aligned magnets are similarly polarized. Thus, as shown in FIG. 2, the radially outer ends of all sets of magnets at the opposite ends of the unit are of one polarity whereas the radially outer ends of the intermediate sets of magnets are of the opposite polarity.

The magnet sets in each row are magnetically interconnected by a flux bar 36 extending axially along the radially inner ends of the magnets. Thus, the flux bars 36 extend the full length of the unit. These bars are dimensioned in relation to the other components of the unit so that they can be welded together along their longitudinal edges as at 38. The radially stacked individual magnets are preferably cemented together and also cemented to the outer face of the flux bars 36. The entire magnet arrangement is fixedly secured within shell 32 by means of a mixture of sand and epoxy cement which is designated 40. The entire assembly of tube 32 and the magnet units cemented therein is referred to herein as the "magnet cylinder 28". The magnet cylinder is fixedly supported on the angle brackets 26 by means of a radial support bar 42 preferably welded to the angle brackets 26. The radially outer end of support bar 42 has a pair of deflector plates 44 fixed thereto which are reinforced by angle brackets 46.

Stripper shell 30 comprises a circular cylindrical sleeve 48 having a diameter only slightly greater than tube 32 so as to be slideable thereover. Sleeve 48 is axially slotted as at 50 to accommodate support bar 42. Sleeve 48 is formed of a non-magnetic material such as non-magnetic stainless steel. At the front end thereof sleeve 48 is closed by a cap 52 which has a diameter at least slightly larger than the diameter of the sleeve. At its rear end sleeve 48 is provided with a ring 54, the inner diameter of which corresponds to the diameter of sleeve 48 and the outer diameter of which is at least slightly larger than the diameter of sleeve 48.

In the arrangement illustrated three bands 56 of magnetic material are arranged around the outer periphery of sleeve 48. These bands are spaced axially of sleeve 48 so that they lie generally centrally between the opposite ends of the circumferentially aligned sets of magnets 34. As shown in FIG. 3, the opposite ends of bands 56 are parted to accommodate support bar 42.

In a typical arrangement the magnet cylinder 28 has an outer diameter of about 11" and the stripping cylinder 30 has an inner diameter of about $11\frac{1}{4}$". The overall length of the unit is about 22". The magnets have a thickness of 1" and a width of 3". The magnets at the opposite ends of the unit have a length of 6" and the intermediate sets of magnets have a length of 8". The space or air gap 58 between axially adjacent sets of magnets is about $\frac{3}{4}$". The bands 56 are formed of magnetic stainless steel and are about 2" wide and have a thickness of about $\frac{1}{8}$". As is apparent from FIG. 1, the magnet assembly is mounted within the dump pit 10 in axial alignment with the access opening 20 and the opening 20 is sufficiently large so that the stripper shell 30 is slideable over the magnet cylinder 28 inwardly and outwardly of the dump pit through opening 20. The dimensions set forth above are typical of a particular installation. They may vary within wide limits depending upon the size and configuration of the dump pit in which the magnet assembly is mounted.

During operation of the dump pit, stripper shell 30 is telescoped over the magnet cylinder 28 in the position shown in FIG. 2 and the access door 22 is closed. The grain flows downwardly through the dump pit and onto conveyor 16. The size of the magnet assembly is such that any tramp metal within the grain is attracted to the stripper shell 30 as it flows downwardly past the magnet assembly. The deflector plates 44 deflect the grain and any tramp metal therein outwardly away from the slot 50 along the upper side of sleeve 48. It will be appreciated that, since the successive magnets in a row are of opposite polarity with an air gap 58 therebetween, a strong magnetic field bridges the radially outer ends of successive magnets in each row through the non-magnetic sleeve 48. In addition, the metallic bands 56 concentrate the magnetic field between the ends of the successive axially spaced sets of magnets and increases the magnetic attraction for the tramp metal by about seven or eight times what the magnetic force would be without these bands. Thus, any tramp metal flowing past the magnet assembly is attracted to the stripper shell 30 and tends to migrate toward the closest band 56 and adhere thereto. After a predetermined amount of tramp metal has accumulated on the stripper shell, door 22 is opened and the stripper shell is retracted outwardly from around the magnet cylinder 28 through opening 20 as illustrated in FIG. 1. The metal objects will tend to cling to the bands 56. Any metal which tends to roll or slide over the shell axially as it is retracted will encounter the abutments formed by bands 56 and/or ring 54 so that it will, in any event, be displaced axially with the shell. As the non-magnetic stripper shell is progressively displaced outwardly beyond the outer end of magnet cylinder 28, most of the tramp metal accumulating on the stripper shell will automatically fall off into a receptacle 60 as it advances axially beyond the outer end of the magnet cylinder. Any metal objects which remain adhered to bands 56 because of the residual magnetism therein can be easily wiped off manually. Thereafter the stripper shell is telescoped inwardly over the magnet cylinder 28 back to the position shown in FIG. 2 and the door 22 is closed so that discharge of grain through the dump pit can be resumed.

Although the dump pit referred to herein is described in connection with the loading and handling of grain, it will be appreciated that it can be used in connection with the handling of any other free flowing powder, granular or pelletized gravity fed material such as chemicals, plastics, food stuffs, etc.

We claim:

1. In combination a hopper into the upper end of which grain is adapted to be admitted in a vertically downward direction, said hopper having an open lower end through which the grain flowing downwardly through the hopper is adapted to be discharged, said hopper having side walls extending vertically between its upper and lower ends, a plurality of magnets secured together to form a magnet cylinder in said hopper arranged with its axis extending horizontally, a support bar extending axially of said magnet cylinder and projecting radially upwardly from the uppermost surface thereof, the lower edge of said support bar being fixedly secured to said magnet cylinder, means fixed to the upper edge of said support bar and connected with side walls of said hopper for supporting the magnet cylinder in fixed position within the hopper intermediate the upper and lower ends thereof, a cylindrical stripper shell of non-magnetic material telescopically received over said magnet cylinder, said shell having an axially extending slot therein extending to at least one end of the shell for accommodating said support bar, a radially outwardly extending abutment extending around said one end of said shell to the opposite sides of said slot, said shell having a diameter at least slightly larger than the diameter of the magnet cylinder so as to be slideably supported thereon, one side wall of the hopper having an opening therein aligned axially with said shell and through which the shell is adapted to be axially withdrawn, a panel for optionally closing said opening, said shell being arranged on said magnet cylinder with the end thereof provided with said radial abutment remote from the end of the magnet cylinder adjacent the opening in the hopper.

2. The combination called for in claim 1 wherein said magnets are arranged in axially extending rows spaced circumferentially around the cylinder, each row containing a plurality of magnets spaced axially apart, the radially outer ends of adjacent magnets in each row being of opposite polarity.

3. The combination called for in claim 2 wherein the magnets in each row are circumferentially aligned with the magnets in the other rows, the polarity of the circumferentially aligned magnets being the same.

4. The combination called for in claim 3 including a circumferentially extending band formed of magnetic material surrounding said shell at a location intermediate the axially opposite ends of each set of circumferentially aligned magnets.

5. The combination called for in claim 1 including a pair of deflector plates mounted on said support bar, said deflector plates extending lengthwise of the support bar and overlying said slot when the shell is supported on the magnet cylinder, said deflector plates being inclined downwardly in opposite directions from said support bar.

* * * * *